United States Patent [19]

Spicer

[11] 3,961,182

[45] June 1, 1976

[54] PICK UP SCREENS FOR X-RAY IMAGE INTENSIFIER TUBES EMPLOYING EVAPORATED ACTIVATED SCINTILLATOR LAYER

[75] Inventor: William E. Spicer, Stanford, Calif.

[73] Assignee: Varian Associates, Palo Alto, Calif.

[22] Filed: Aug. 18, 1972

[21] Appl. No.: 281,905

Related U.S. Application Data

[60] Division of Ser. No. 7,358, Feb. 3, 1970, Pat. No. 3,795,531, which is a continuation of Ser. No. 606,514, Dec. 22, 1966, abandoned.

[52] U.S. Cl. ..... 250/213 VT; 313/380; 250/369

[51] Int. Cl.[2] ..... H01J 31/50

[58] Field of Search . 250/213 VT, 213 A, 361–363, 250/368, 369; 313/94, 101, 373, 380; 29/572, 581, 582, 25.17, 25.18; 117/33.5 C

[56] References Cited

UNITED STATES PATENTS

| | | | |
|---|---|---|---|
| 1,954,691 | 4/1934 | De Boer et al. | 250/34 |
| 2,248,630 | 7/1941 | Johnson et al. | 250/80 |
| 2,257,827 | 10/1941 | Weissenberg | 250/27.5 |
| 2,264,717 | 12/1941 | Ruedy | 250/165 |
| 2,523,132 | 9/1950 | Mason | 250/165.5 |
| 2,525,832 | 10/1950 | Sheldon | 178/7.2 |
| 2,585,551 | 2/1952 | Hofstadter | 250/483 |
| 2,586,392 | 2/1952 | Sheldon | 250/65 |
| 2,600,579 | 6/1952 | Ruedy et al. | 117/33.5 |
| 2,673,816 | 3/1954 | Neuhaus | 117/33.5 |
| 2,676,113 | 4/1954 | Jervis | 117/33.5 |
| 2,681,420 | 6/1954 | Teves et al. | 313/65 |
| 2,699,511 | 1/1955 | Sheldon | 250/213 VT X |
| 2,727,863 | 12/1955 | Fonda | 252/301.4 |
| 2,789,062 | 4/1957 | Cusano et al. | 117/33.5 |
| 2,798,823 | 7/1957 | Harper | 117/33.5 |
| 2,890,359 | 6/1959 | Heijne et al. | 313/65 |
| 2,898,225 | 8/1959 | Rychlewski et al. | 117/33.5 |
| 2,903,378 | 9/1959 | Rychlewski | 117/33.5 |
| 2,936,246 | 5/1960 | Coghill | 117/33.5 |
| 2,967,111 | 1/1961 | Coghill et al. | 117/33.5 |
| 2,983,816 | 5/1951 | Koller | 250/80 |
| 3,023,313 | 2/1962 | de la Mater et al. | 250/487 |
| 3,048,698 | 8/1962 | Carlson | 250/71.5 |
| 3,213,308 | 10/1965 | Feibelman | 313/380 |
| 3,356,851 | 12/1967 | Carlson | 250/213 VT |
| 3,373,279 | 5/1968 | Hofstader | 252/301.4 H |
| 3,558,893 | 1/1971 | Ball | 250/213 VT |
| 3,795,531 | 3/1974 | Spicer | 250/486 X |

FOREIGN PATENTS OR APPLICATIONS

| | | | |
|---|---|---|---|
| 20832/59 | 12/1959 | Japan | |
| 155/61 | 1/1961 | Japan | |
| 668,854 | 3/1952 | United Kingdom | |
| 713,924 | 8/1954 | United Kingdom | |
| 720,621 | 12/1954 | United Kingdom | |
| 729,521 | 5/1955 | United Kingdom | |
| 839,681 | 6/1960 | United Kingdom | |
| 1,201,001 | 8/1970 | United Kingdom | |
| 747,855 | 4/1956 | United Kingdom | 250/213 VT |
| 716,064 | 9/1954 | United Kingdom | 250/213 VT |

OTHER PUBLICATIONS

"$C_sI$(NA) Scintillation Crystals" — by Brinkman — Physics Letters, vol. 15, No. 4, p. 305, Apr. 1965.

"On the Activation of Oxide—Coated Cathodes," by Hamaker, et al.–Phillips Res. Rep. 2, 171, (1947).

"Monochromatic –. . . " by Rosterkamp Medica Mundi, (1961), pp. 68–77.

"The Oxide—Coated Cathode," by Herman, et al., 1951, p. 113.

Albrecht, et al., X–Ray Screens With Reduced Information Losses, 5 Medici Mundi; pp. 80–84, 1959.

*Primary Examiner*—Walter Stolwein

*Attorney, Agent, or Firm*—Stanley Z. Cole; David R. Pressman; Harry E. Aine

[57] ABSTRACT

The present invention relates in general to methods for making pick-up screens for X-ray image intensifier tubes and, more particularly, to an improved method wherein the X-ray fluorescent phosphor screen element is formed by evaporation of an alkali metal halide material in vacuum and condensing the evaporated material on an X-ray transparent portion of the X-ray intensifier tube, whereby a curved X-ray image pick-up screen is formed which has improved quantum efficiency and resolution. Such improved X-ray image intensifier tubes are especially useful for, but not limited in use to, X-ray systems and for intensifying gamma ray images obtained in applications of nuclear medicine.

7 Claims, 5 Drawing Figures

FIG. 1
PRIOR ART
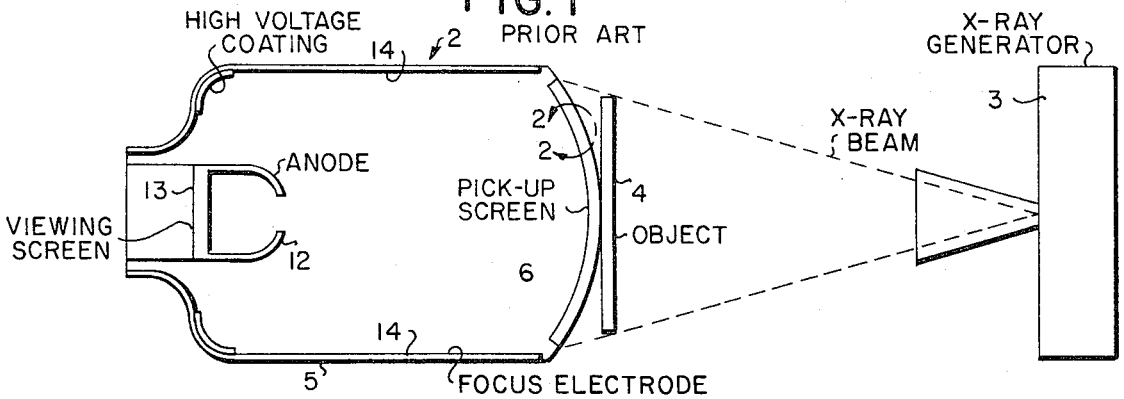
FIG. 2
PRIOR ART
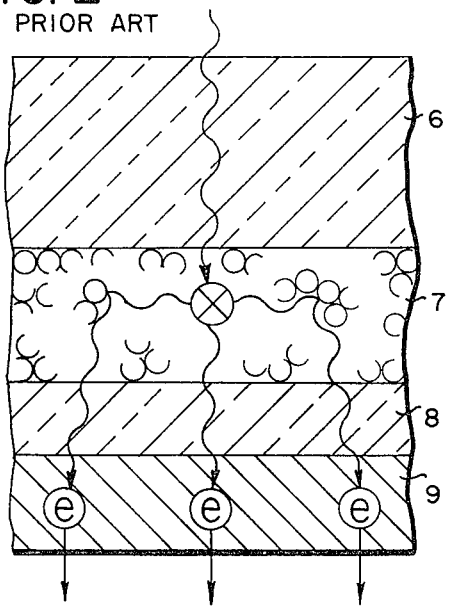
FIG. 3
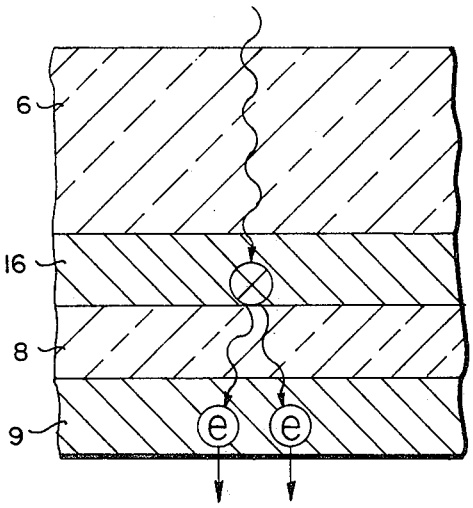
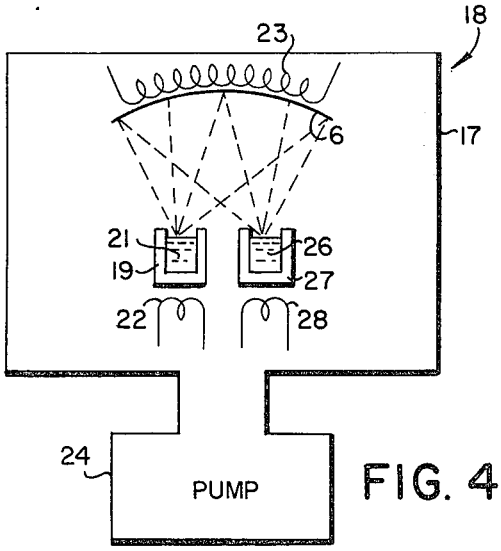
FIG. 4
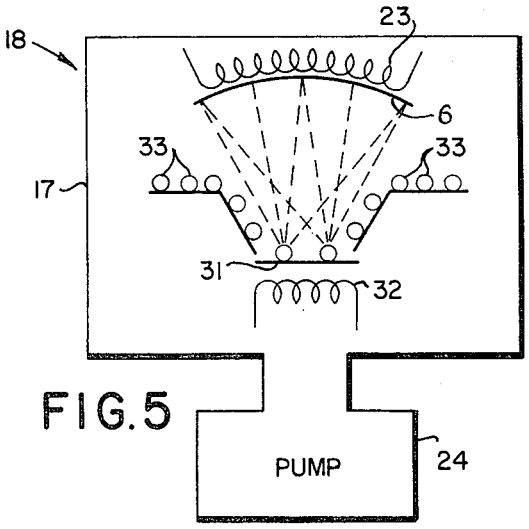
FIG. 5

PICK UP SCREENS FOR X-RAY IMAGE INTENSIFIER TUBES EMPLOYING EVAPORATED ACTIVATED SCINTILLATOR LAYER

RELATED CASES

The present application is a divisional application of copending application Ser. No. 7,358, filed Feb. 3, 1970, now U.S. Pat. No. 3,795,531; granted Mar. 5, 1974 which in-turn is a continuation application of parent application Ser. No. 606,514 filed Dec. 22, 1966 and now abandoned, all of such applications being assigned to the same assignee as the present application.

Heretofore, X-ray image pick-up screens for X-ray image intensifier tubes have been made by settling phosphor particles out of a liquid slurry onto an X-ray transparent spherical dish, as of aluminum, forming the pick-up face of the evacuated image intensifier tube. While such techniques are suitable for ZnS pick-up screen materials they are generally unsuited for producing alkali metal halide screens which should provide improved X-ray quantum efficiencies. Moreover, the particulated screen produced by such settling methods has only about half the density of the bulk material and has poorer resolution than that obtainable from a screen having a higher density of the screen material. Also it would be desirable to use a screen material having higher stopping power and quantum conversion efficiency such as that provided by the alkali metal halides.

While it may be possible to form the pick-up screen of a thin slab of alkali metal halide, which has been deformed to produce the spherical shape, such a deformation of the slab of phosphor material may seriously degrade the conversion efficiency and, thus, resolution of the converted X-ray image because of the plastic deformation of the alkali halide.

In the present invention, the spherical pick-up screen is formed by evaporation of an alkali halide material, such as CsI, KI, NaI, RbI, CsBr, or LiI, in vacuum onto the inside of the spherical X-ray transparent pick-up face plate of the image intensifier tube. Such an evaporated pick-up screen has a density which is approximately equal to that of the bulk material and, therefore, will provide enhanced resolution and quantum conversion efficiency.

In one embodiment of the present invention, the alkali halide phosphor screen material is co-evaporated with its activator material either by evaporation of an activated alkali metal halide or by simultaneous evaporation of the alkali metal halide and its activator.

In another embodiment of the present invention, the alkali halide screen is evaporated and condensed in place and subsequently activated by coating the screen with the activator, as by evaporation, and then diffusing the activator from the coating into the screen material.

The principal object of the present invention is the provision of methods for making improved X-ray image intensifier tubes.

One feature of the present invention is the provision of a method for making the X-ray pick-up screen of an image intensifier tube wherein an alkali metal halide screen material is evaporated in vacuum onto a curved X-ray transparent substrate, whereby a phosphor screen is produced which has improved resolution and quantum conversion efficiency.

Another feature of the present invention is the same as the preceding wherein the alkali halide material is coevaporated with its activator material.

Another feature of the present invention is the same as the preceding feature wherein the alkali halide to be evaporated includes its activator.

Another feature of the present invention is the same as the first feature wherein the alkali halide material and its activator material are simultaneously evaporated from separate sources onto the substrate member.

Another feature of the present invention is the same as the first feature wherein the alkali halide screen, as deposited on the substrate, is activated by coating the surface of the screen with an activator material and then diffusing the activator into the alkali halide screen by raising the screen to an elevated temperature.

Another feature of the present invention is the same as any one or more of the preceding features wherein the alkali metal halide screen is annealed to remove minute residual plastic deformation of the material.

Other features and advantages of the present invention will become apparent upon a perusal of the following specification taken in connection with the accompanying drawings wherein:

FIG. 1 is a schematic line diagram of an X-ray image intensifier tube of the prior art, FIG. 2 is an enlarged cross sectional view of a portion of the structure of FIG. 1 delineated by line 2—2, FIG. 3 is a side view similar to that of FIG. 2 depicting the pick-up screen construction of the present invention, FIG. 4 is a schematic line diagram of an apparatus for evaporating alkali halide materials in vacuum, and FIG. 5 is an alternative evaporator apparatus to that depicted in FIG. 4.

Referring now to FIG. 1, there is shown a prior art X-ray system 1 employing an X-ray image intensifier tube 2. Such a system is described in an article entitled, "X-Ray Image Intensification With A Large Diameter Image Intensifier Tube", appearing in the American Journal Of Roentgenology Radium Therapy And Nuclear Medicine, Volume 85, pages 323–341 of February 1961. Briefly, an X-ray generator 3 serves to produce and direct a beam of X-rays onto an object 4 to be X-rayed. The image intensifier tube 2 is disposed to receive the X-ray image of the object 4.

The image intensifier tube 2 includes a dielectric vacuum envelope 5 as of glass approximately 17 inches long and 10 inches in diameter. The pick-up face portion 6 of the tube 2 comprises a spheical X-ray transparent portion of the envelope 5, as of aluminum or conductive glass, which is operated at cathode potential. An image pick-up screen 7 of X-ray sensitive particulated phosphor such as ZnS is coated onto the inside spherical surface of the envelope portion 6 to a thickness as of 0.020 inch. A chemically inert optically transparent buffer layer 8 is coated over the phosphor layer 7. A photo-cathode layer 9 is formed over the buffer layer 8.

In operation, the X-rays penetrate the object 4 to be observed. The local X-ray attenuation depends on both the thickness and atomic number of the elements forming the object under observation. Thus, the intensity pattern in the X-ray beam after penetration of the object 4 contains information concerning the structure of the object. The X-ray image passes through the X-ray transparent envelope section 6 and falls upon the X-ray sensitive phosphor layer 7 wherein the X-ray photons are absorbed and re-emitted as optical photons, typically in the blue frequency range. The optical photons pass through the transparent buffer 8 to the photocathode 9 wherein they produce electrons. The electrons are emitted from the photo-cathode in a pattern or image corresponding to the original X-ray image. The electrons are accelerated to a high velocity, as of 30 KV, within the tube 2 and are focused through an anode structure 12 onto a fluorescent screen 13 for viewing by the eye or other suitable optical pick-up device. Electron focusing electrodes 14 are deposited on the interior surfaces of the tube 2 to focus the electrons through the anode 12.

In the intensifier tube, one 50 Kev photon of X-ray energy absorbed by the X-ray sensitive pick-up screen produces about 2000 photons of blue light. These 2000 photons of blue light produce about 400 electrons when absorbed in the photo-emitter layer 9. The 400 electrons emitted from the photo-cathode produce about 400,000 photons of light in the visible band when absorbed by the fluorescent viewing screen 13. Thus, the X-ray image is converted to the visible range and greatly intensified for viewing.

One of the problems with the prior art intensifier tube 2 is that the particulated pick-up screen has less than optimum resolution due to the fact that the particulated material has about one half the density of the material in bulk form. Thus, to provide a certain probability of stopping or absorbing an X-ray photon, the particulated layer 7 must have about twice the thickness of such a layer if it had bulk density. The thicker the layer 7 the poorer its X-ray resolution. Moreover, the particulated material serves to scatter the emitted optical photons, thereby still further reducing resolution.

In addition, it is desirable to utilize a pick-up screen material having a greater intrinsic stopping or absorbing power for X-rays. Such improved materials include the alkali metal halides such as, for example, CsI, KI, NaI, RbI, CsBr, and LiI. These improved materials such as CsI and NaI are obtainable in bulk slab form from Harshaw Chemical Company of Cleveland, Ohio. However, when they are distorted from the slab form into the spherical slab form, to conform to the spherical pick-up face 6 of the image intensifier tube 2, it is expected that the conversion efficiency and, hence, resolution of the converted X-ray image is deleteriously affected.

Referring now to FIGs. 3–5 there is shown a section of the X-ray pick-up screen formed in accordance with the methods of the present invention. More particularly, the alkali halide pick-up screen layer 16 is formed on the spherical X-ray transparent substrate member 6 by evaporation in vacuum.

In a first method, the substrate member 6 is cleaned and disposed in a vacuum chamber 17 of a vacuum evaporator 18. A crucible 19 containing the activated alkali metal halide phosphor 21 in bulk form is heated to a temperature sufficient to evaporate the phosphor material as by an electrical heating element 22. The evaporated activated alkali halide is condensed (deposited) on the substrate 6 to the desired thickness, as of 0.010 inch for an X-ray image intensifier, or to 0.060 inch for a gamma ray intensifier. As used herein, "X-ray" is defined to include X-rays and other high energy radiation including gamma ray radiation.

The bulk activated alkali halide may include any one of a number of different activators to render the pick-up screen 16 fluorescent upon absorption of X-rays at room temperature. For example, CsI may include TlI or NaI, Na or LiI as activators.

After the screen layer 16 has been deposited it is preferably annealed to remove any residual minute plastic deformations thereof because such deformations have an adverse effect upon quantum conversion efficiency. A suitable annealing process is to heat the screen 16 as by heater 23 in vacuum to within 10°C of the melting point of the screen material for 0.5 to 2.0 hours and then cool the screen 16 through to 400°C in 10 hours and then cool to room temperature in another 10 hours.

An ultra clean vacuum pump 24 is connected into the evaporation chamber 17 to maintain the vacuum within the system at about $10^{-9}$ Torr during the evaporation process.

The deposited layer of phosphor 16 is polycrystalline and has a density approximately equal to the bulk density of the alkali metal halide material. The polycrystalline nature of the vacuum evaporated alkali metal halide material is well known. See, for example, *The Physical Review*, Vol. 51 No. 5, of Mar. 1, 1937, pages 293–299, especially pages 295–297. Therefore, the X-ray stopping or absorption power of the layer 16 is substantially improved for a given thickness as compared to the prior particulated phosphor screens. Thus, the thickness of the layer 16 can be reduced compared to the prior screens, thereby providing improved resolution. Moreover, the spherical shape of the layer 16 does not interfere with resolution as would be expected to be encountered if a slab of the alkali halide material were shaped to conform to the spherical substrate 6.

A second method for forming the evaporated pick-up screen 16 is essentially the same as the first method except that the activator material is not incorporated in the bulk phosphor material 21 to be evaporated. Instead, the activator material 26 is simultaneously evaporated from a second crucible 27 which is heated by a separate heater 28. This method provides better control over relative rates of deposition of the alkali halide and its activator in order to assure a better control over the distribution of the activator in the deposited screen layer 16. As an alternative to employing the second crucible 27, the activator is vaporized in the chamber 17 to form a vapor in equilibrium. The alkali halide material, without the activator, is then evaporated through the activator vapor and, thus, co-deposited with the activator vapor on the substrate 6.

A third method for forming the screen layer 16 is essentially the same as the second method except that the activator is post evaporated to form a layer upon the previously deposited layer of alkali metal halide screen material. The activator is then diffused into the alkali metal halide screen layer by annealing as previously described with regard to the first method.

A fourth method for forming the pick-up screen layer 16 is essentially the same as any one of the aforedescribed methods except that the materials to be evaporated from a heated crucible are instead flash evaporated. More particularly, an evaporation plate 31 is heated by a heater 32 to a temperature well in excess of the evaporation temperature of the constitutents of the material to be evaporated. Pellets 33 of the material to be evaporated which in some methods, as aforedescribed, include the alkali metal halide with the activator incorporated therein, and in others of the aforedescribed methods have the activator separately evaporated, are dropped upon the plate 31 for flash evaporation. The evaporated material is collected on the substrate 6 to form the pick-up polycrystalline screen layer 16. For the methods wherein the activator is separately evaporated the proportions of activator and alkali metal halide, in the resultant deposited layer 16, are controlled by controlling the rate at which the separate activator and alkali metal halide pellets are dropped upon the evaporation plate 31. The resultant screen layer 16 may be heat treated or annealed, as aforedescribed, to obtain a more uniform distribution of the activator within the alkali metal halide material and to remove residual plastic deformation.

Still other methods for evaporation of the alkali metal halide material in vacuum onto the curved face plate 6 include electron beam and laser beam evaporation methods.

The buffer layer 8 is formed over the pick-up screen layer 16 by evaporating a chemically inert and optically transparent material over the layer 16 to a thickness less than 10,000 A and preferably 1000 A or less. Suitable buffer materials include magnesium oxide, aluminum oxide and lithium fluoride. Such materials are evaporated in vacuum in the same manner as previously described for evaporation of the pick-up screen materials. As an alternative, the buffer layer 8 is formed, in some instances, by evaporating the metal constitutent such as aluminum or magnesium and then reacting the deposited metal film with the other constitutent of the buffer such as oxygen gas, which is introduced into the vacuum chamber 17, to form the buffer layer 8. The photo-cathode layer 9, as of $Cs_3Sb$, is deposited over the buffer layer 8 by conventional vacuum evaporation methods for forming such cathodes. Such a method is described in a book entitled, "Photoelectronic Materials and Devices" published by D. Van Nostrand Company, Inc. in 1965 at pages 200–201.

One advantage of the aforedescribed vacuum evaporation methods for forming the pick-up screen 16 and subsequent buffer and photo-cathode layers 8 and 9, respectively, is that such methods are all performed in vacuum such that they lend themselves to a production machine which performs the successive steps in vacuum without having to take the parts into air for performing successive steps in the manufacture.

Since many changes could be made in the above construction and many apparently widely different embodiments of this invention can be made without departing from the scope thereof it is intended that all matter contained in the above description or shown in the accompanying drawings shall be interpreted as illustrative and not in a limiting sense.

What is claimed is:

1. An evacuated x-ray image intensifier tube of improved conversion efficiency and resolution comprising:

evacuated envelope means;

an x-ray pick-up screen disposed within said evacuated envelope means for receiving an x-ray image and converting said x-ray image by scintillation into an optical photon image corresponding to the received x-ray image, said x-ray pick-up screen comprising a vacuum vapor deposited polycrystalline layer of alkali metal halide scintillator material, said scintillator material including an activator so as to be x-ray sensitive and selected from the group consisting of CsI, NaI, LiI, KI, CsBr, and RbI, having a density of alkali metal halide material approximately equal to that of the bulk alkali halide material, and having a thickness greater than 0.0005 inch; and a photocathode layer behind said x-ray pick-up screen for converting said photon image to a corresponding electron image for emission into said evacuated envelope.

2. The x-ray image intensifier tube of claim 1 further including electrode means for focusing said electron image, and an output screen for converting said focused image electron image into a visible intensified image of said electron image.

3. The apparatus of claim 1 wherein said scintillator layer is activated CsI.

4. The apparatus of claim 3 wherein said scintillator layer includes an activator material selected from the class consisting of TlI, NaI, Na, and LiI.

5. The apparatus of claim 1 wherein said scintillator layer is curved.

6. The apparatus of claim 1 wherein said scintillator layer is a layer of material condensed onto a support member in vacuum from the vapor phase.

7. The apparatus of claim 3 wherein said photocathode material includes cesium and antimony.

* * * * *

UNITED STATES PATENT AND TRADEMARK OFFICE

CERTIFICATE OF CORRECTION

PATENT NO. : 3,961,182

DATED : June 1, 1976

INVENTOR(S) : William E. Spicer

It is certified that error appears in the above-identified patent and that said Letters Patent are hereby corrected as shown below:

On the cover sheet, in the heading, under the section "Related U.S. Application Data", line 3, change the date from "December 22, 1966" to -- December 27, 1966 --.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*